US007641523B2

(12) United States Patent
Chen

(10) Patent No.: US 7,641,523 B2
(45) Date of Patent: Jan. 5, 2010

(54) POWER CONNECTOR ASSEMBLY

(75) Inventor: Chu-Lin Chen, Jhonghe (TW)

(73) Assignee: Alltop Electronics (Su Zhou) Co., Ltd, Taicang, Jiangsu Province (CN)

( * ) Notice: Subject to any disclaimer, the term of this patent is extended or adjusted under 35 U.S.C. 154(b) by 0 days.

(21) Appl. No.: 12/190,975

(22) Filed: Aug. 13, 2008

(65) Prior Publication Data

US 2009/0263984 A1 Oct. 22, 2009

(30) Foreign Application Priority Data

Apr. 21, 2008 (CN) ..... 2008 1 0096014

(51) Int. Cl.
*H01R 12/00* (2006.01)

(52) U.S. Cl. ..... 439/825; 439/65; 439/78

(58) Field of Classification Search ..... 439/825, 439/65, 78, 947.2, 188
See application file for complete search history.

(56) References Cited

U.S. PATENT DOCUMENTS

| | | | | | |
|---|---|---|---|---|---|
| 4,416,504 | A * | 11/1983 | Sochor | 439/825 |
| 4,526,429 | A * | 7/1985 | Kirkman | 439/82 |
| 5,051,108 | A * | 9/1991 | Lincoln | 439/825 |
| 5,791,923 | A * | 8/1998 | Picaud et al. | 439/188 |
| 6,074,326 | A * | 6/2000 | Sakakibara et al. | 477/169 |
| 6,319,075 | B1 | 11/2001 | Clark et al. | |
| 6,890,221 | B2 * | 5/2005 | Wagner | 439/855 |
| 7,070,464 | B2 * | 7/2006 | Clark et al. | 439/825 |
| 7,309,242 | B2 * | 12/2007 | Clark et al. | 439/79 |
| 7,314,377 | B2 * | 1/2008 | Northey et al. | 439/79 |
| 7,488,222 | B2 * | 2/2009 | Clark et al. | 439/825 |
| 2003/0181106 | A1 * | 9/2003 | Schell et al. | 439/825 |
| 2006/0194481 | A1 * | 8/2006 | Clark et al. | 439/825 |
| 2008/0214027 | A1 * | 9/2008 | Schell et al. | 439/79 |

FOREIGN PATENT DOCUMENTS

CN 200820031892.1 2/2008

* cited by examiner

*Primary Examiner*—Gary F. Paumen
(74) *Attorney, Agent, or Firm*—Sughrue Mion, PLLC

(57) ABSTRACT

A power connector is provided which includes an insulating housing having a plurality of contact receiving passages, each of said plurality of contact receiving passages receives a contact pair having a pair of independent conductive contacts, each of said independent conductive contacts has a base portion and a contacting portion extending from said base portion, a retention portion extends from at least one of said independent conductive contacts to another one of said independent conductive contacts, and rests on said another one of said independent conductive contacts when said contacting portion deforms under force, so as to prevent said contacting portion of said conductive contact from over deforming under force, and ensure the stability of power transmission.

19 Claims, 5 Drawing Sheets

POWER CONNECTOR ASSEMBLY

BACKGROUND OF THE INVENTION

1. Field of the Invention

The present invention relates to a power connector and a contact retention structure used thereof, and more particularly to an assembly of a receptacle and a plug connectors for transmitting power between circuit boards and the mating receptacle and plug contacts used thereof.

2. Description of Related Art

Designers of electronic circuits generally are concerned with two basic circuit portions, the logic or signal portion and the power portion. In designing logic circuits, the designer usually does not have to take into account any changes in electrical properties, such as resistance of circuit components that are brought about by changes in conditions, such as temperature, because current flows in logic circuits are usually relatively low. However, power circuits can undergo changes in electrical properties because of the relatively high current flows. Consequently, connectors designed for use in power circuits must be capable of dissipating heat (generated primarily as a result of the Joule effect) so that changes in circuit characteristics as a result of changing current flow are minimized U.S. Pat. No. 6,319,075 discloses a power connector assembly used in power transmission application, which includes a receptacle connector and a mating plug connector assembled on a circuit board, said receptacle connector includes an insulating receptacle housing and receptacle contact assembly assembled in said insulating receptacle housing, said plug connector includes an insulating plug housing and plug contact assembly assembled in said insulating plug housing. Referring to FIG. 1, each of said receptacle contact 10 includes two pieces of planar base portions 12, 14 connected on the top, and an upper and a lower curved contacting arms 16, 20 extending forwardly from the front of said base portion. When said receptacle connector is mated with said plug connector to be electrically connected, said plug and said receptacle contacting arms resiliently contact with each other, said receptacle contact 10 deforms under the pressing force when said plug contact being inserted, while the U shaped connection portion 42, 44 on top of said planar base portions 12, 14 of said receptacle contact 10 can provide an opposite supportive force to keep the contacting portion of said receptacle contact 10 from over deforming. Also, the receptacle as disclosed in this patent is configured in one piece, the connection portion of said base portion of the contact is U shaped, which needs to be bent after the base portion of the contact has been stamped, the process of bending normally results in a crack of the contact at a position where is bent, consequently the electrical conductive characteristics of the material could be influenced and the quality could be affected as well. Moreover, the high temperature during welding could also cause the relief of the inner metal stress of the bent contact, which could influence the precision of welding foot of the contact due to the expanding of the contact, as a result, the contact could not be smoothly contacted with circuit board and the welding foot of the contact could also be broken.

To overcome the disadvantages as disclosed in this patent, another Chinese Utility Model patent No. 200820031892.1 of the present applicant on an invention of a power connector assembly and mating contacts used thereof discloses an improved receptacle contact. Referring to FIG. 2, each of the receptacle contact pair 220 includes a pair of independent receptacle contacts 221, 222. Each of the receptacle contacts includes a rectangular planar base portion, a mounting leg extending downwardly from said base portion, and a contacting arm extending forwardly from said base portion. Said receptacle contact is configured in two pieces and manufactured directly by injection mould without the above problems as occurred during bending process, therefore the quality can be effectively improved while the cost of manufacturing can be reduced, also it can be easily assembled, and the manufacturing process becomes simple while the quality can be stabilized. In addition, because no connection or support is provided between said receptacle contacts 221, 222, the contacting arm of said receptacle contact could be over deformed or crumpled due to the pressing force exerted when the plug contact is inserted into the contacting arm of the receptacle contacts 221, 222, therefore the performance of power transmission of the receptacle contacts could be influenced.

Therefore, there are still some rooms that could be further improved about the configuration of the contact used in the power connector.

SUMMARY OF THE INVENTION

Accordingly, an object of the present invention is to provide a power connector, the design of contact retention structure of the contact enhances the stability and reliability of the power transmission of said power connector.

In order to achieve above mentioned object, a power connector according to one of the preferred embodiments of the present invention includes an insulating housing having a plurality of contact receiving passages, each of said plurality of contact receiving passages receives a contact pair having a pair of independent conductive contacts, each of said independent conductive contacts has a base portion and a contacting portion extending from said base portion, wherein a retention portion extends from at least one of said independent conductive contacts to another one of said independent conductive contacts, and said retention portion rests on said another one of said independent conductive contacts when said contacting portion deforms under force.

As an advantageous embodiment of the present invention, said pair of independent conductive contacts of said contact pair is spaced and mirrorly secured in the same one of said contact receiving passages.

As another advantageous embodiment of the present invention, each of said conductive contacts has said retention portion extending opposite to said another one of said independent conductive contacts.

As a further advantageous embodiment of the present invention, said retention portion of said pair of said independent conductive contacts of each of said contact pair is apart from each other when no force exerted on said contacting portion of said conductive contact.

As another advantageous embodiment of the present invention, said retention portion is disposed on said base portion of said conductive contact, comprising a resilient clip obliquely extending from said base portion to a space formed between said base portion of said pair of independent conductive contacts and a retention end portion defined at the end of said resilient clip.

Moreover, as another advantageous embodiment of the present invention, said power connector is a receptacle connector, said contact pair is a receptacle contact pair received in said contact receiving passage of said receptacle insulating housing of said receptacle connector.

Furthermore, as another advantageous embodiment of the present invention, said conductive contacts of said receptacle contact pair are receptacle contacts, comprising said base portion and a resilient contacting arm extending from said base portion.

In addition, as another advantageous embodiment of the present invention, said power connector is plug connector, said contact pair is a plug contact pair received in said contact receiving passage of said insulating plug housing of said plug connector.

According to another preferred embodiment of the present invention, a power connector assembly includes a receptacle connector and a mating plug connector, said receptacle connector has an insulating receptacle housing and receptacle contact pairs received in contact receiving passages of said insulating receptacle housing, said plug connector has an insulating plug housing and plug contact pairs received in contact receiving passages of said insulating plug housing, wherein each of said receptacle contact pairs has a pair of independent receptacle contacts received in a corresponding contact receiving passage of said insulating receptacle housing, wherein each of said receptacle contact pair has a retention portion extending opposite to another one of said receptacle contact, and said retention portion of said pair of receptacle contacts of said receptacle contact pair rests on each other when said receptacle connector is mated with said plug connector.

As an advantageous embodiment of present invention, said pair of receptacle contacts of said receptacle contact pair is mirrorly received in the same one of said contact receiving passages. Said receptacle contact includes a base portion and a resilient contacting arm extending from said base portion, said retention portion being defined on said base portion of said receptacle contact. Said retention portion includes a resilient clip extending to a space formed between said base portion of said pair of independent conductive contacts.

According to another preferred embodiment of the present invention, a conductive contact pair includes a pair of independent conductive contacts received in a corresponding contact receiving passage of a power connector, each of said conductive contacts has a base portion and a contacting portion extending from said base portion, wherein at least one of said conductive contacts has a retention portion extending opposite to another one of said conductive contacts.

The technical results of the present invention are as follows. Firstly the contact is configured in two pieces to simplify the manufacturing process while stabilize the quality, so as to improve the distribution of high voltage and current. Secondly the retention structure between two pieces of contact can keep the contact from over deforming when being contacted and ensure the reliability of power transmission.

DETAILED DESCRIPTION OF THE INVENTION

Figure 1:
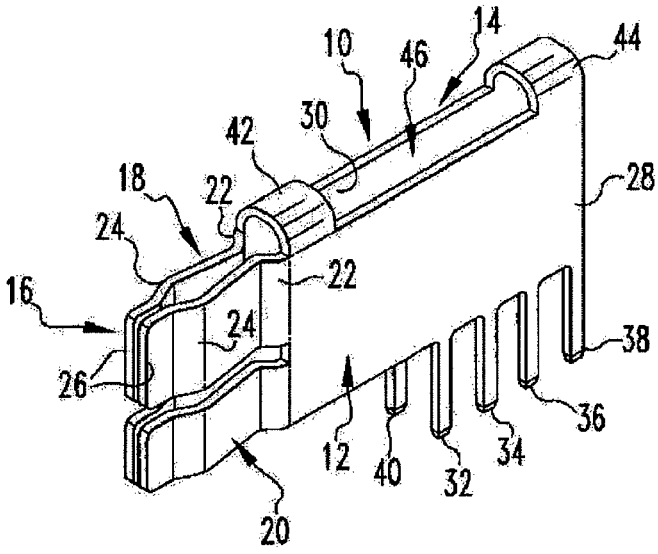
FIG. 1 (Prior art)
FIG. 1 is a perspective view of the conductive contact used in one known power connector.
Figure 2:
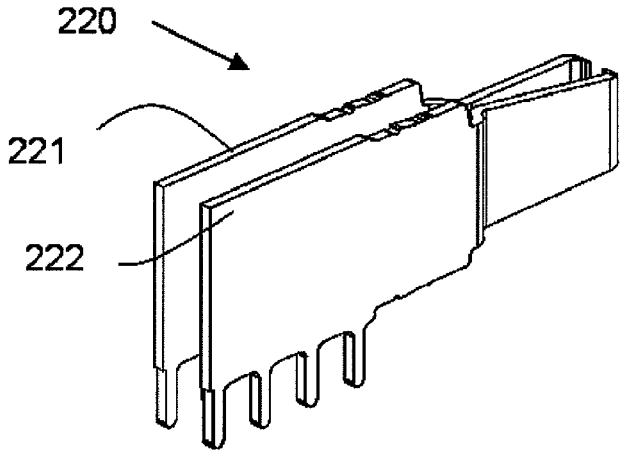
FIG. 2 (Prior art)
FIG. 2 is a perspective view of the conductive contact used in another known power connector.
Figure 3:
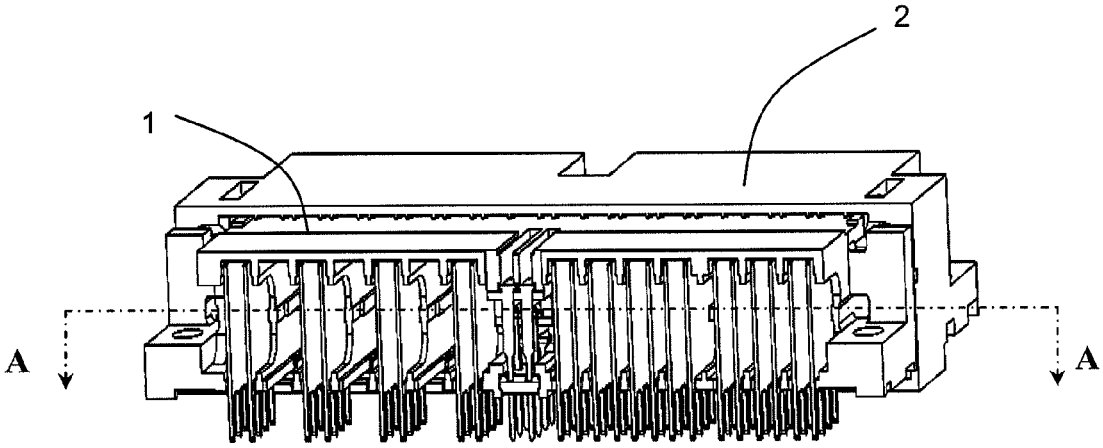
FIG. 3 is a perspective view of an assembly of a receptacle connector and a plug connector according to a power connector assembly of present invention.

Referring to FIG. 3, a power connector assembly according to the present invention includes a pair of mating power connectors, i.e. a first power connector and a second power connector, contacts of each connectors being mated for realizing the transmission of high voltage and current. Said first power connector includes a first insulating housing and a plurality of first power contacts received in said first insulating housing, said second power connector includes a second insulating housing and a plurality of second power contacts received in said second insulating housing. As a preferred embodiment of the present invention, said first power connector is a receptacle connector 2, said second power connector is a plug connector 1, said first power contacts received in said receptacle connector 2 are receptacle contacts, said second power contacts received in said plug connector 1 are plug contacts, said plug connector 1 and said receptacle connector 2 are assembled on one circuit board respectively, and can be mated to be electrically connected for power transmission between two circuit boards.

Figure 4:
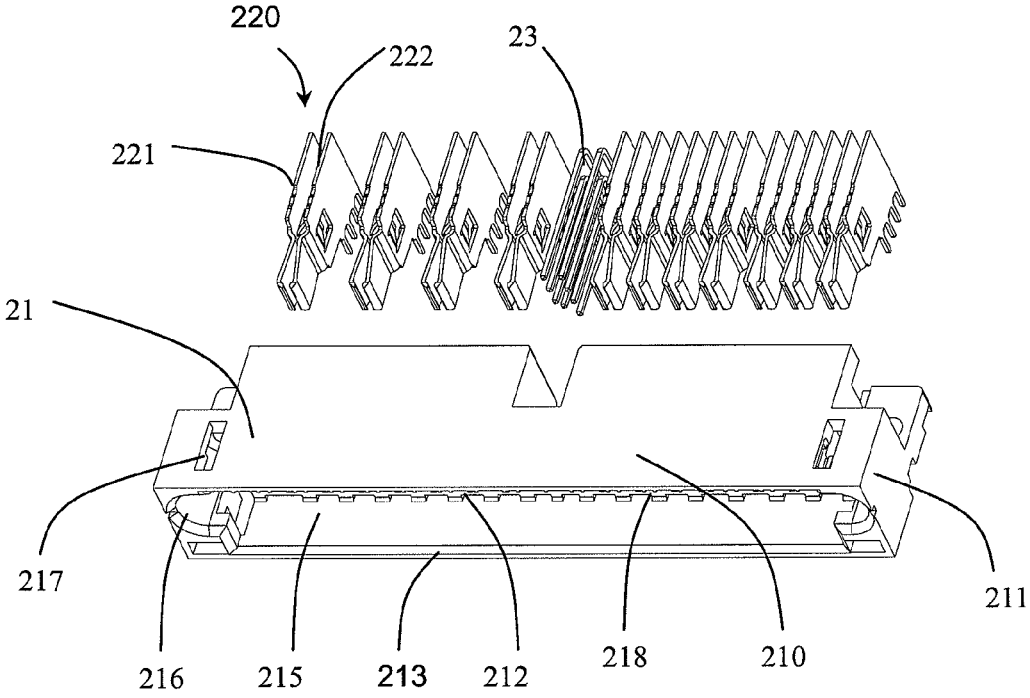
FIG. 4 is an explosively perspective view of a receptacle connector according to present invention.

Referring to FIG. 4, said receptacle connector 2 includes an insulating receptacle housing 21, a plurality of receptacle contact pairs 220 received in said insulating receptacle housing 21 in an array, and a first signal contact assembly 23. Said first signal contact assembly 23 is inserted in a plurality of through holes arranged near to the middle of said insulating receptacle housing 21 in an array, and includes a plurality of pin type signal contacts arranged in an array for transmitting signals.

Approximately being an injection molded longitudinally cubic plastic body; said insulating receptacle housing 21 includes a main portion 210 for receiving said contacts and side portion 211 in both sides of said main portion 210 in a longitudinal direction. Said main portion 210 includes a top wall 212 and a bottom wall 213 in parallel relation to said top wall 212, a middle wall between said top wall 212 and said bottom wall 213, and a longitudinal mating space 215 with an opening in front of said main portion 210 formed between said top wall 212 and said bottom wall 213. A through guiding space 216 is defined on said side wall 211 from the front to the back to connect said mating space 215, a through hole 217 is further defined on top of said side wall 211 to connect said guiding space 216 with said mating space 215. And a plurality of ribs 218 extend from the front to the back of said main portion 210 along the inside surface of said top wall 212.

Figure 5:
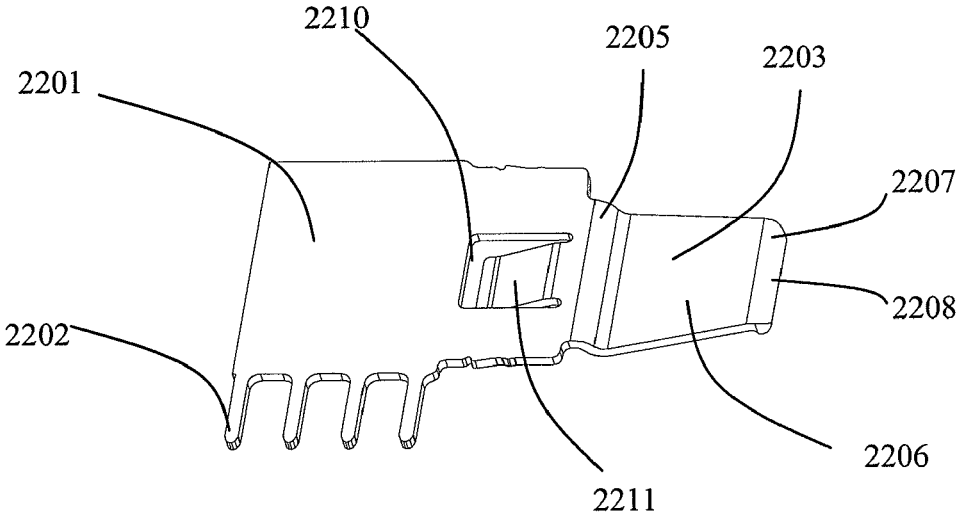
FIG. 5 is a perspective view of a receptacle contact of the receptacle connector according to present invention.

Each of said receptacle contact pairs 220 consists of a pair of independent receptacle contacts 221, 222. Referring to FIG. 5, each of said receptacle contact includes a rectangular planar base portion 2201, a mounting leg 2202 extending downwardly from said base portion 2201, and a contacting arm 2203 extending forwardly from said base portion 2201. According to the preferred embodiment of present invention, each of said receptacle contacts has four said mounting legs

2202 extending downwardly from the back bottom edge of said base portion 2201 to be welded to the corresponding circuit board by Through-hole Technology. Of course, the number of said mounting leg 2202 may vary to meet the requirements in different designs according to other embodiments of present invention. Moreover, the way to connect said mounting leg with circuit board may also be realized by other common known technologies, for example, SMT, or Press-fit Technology. At the top side and bottom side in front of said base portion 2201 a barbed retention portion 2204 is formed respectively. According to the preferred embodiment of present invention, said receptacle contacts 221, 222 of said receptacle contact pair 220 are configured in a manner of face-to-face, and symmetrically mirrored. Being a cantilever in a shape of narrow in front and wide in back, said contacting arm 2203 of said receptacle contact pair 220 includes a pair of bending portion 2205 bent from the front of said base portion 2201 respectively to converge at the inner side, and a contacting portion 2206 bent outwardly further from said bending portion 2205 and extending backwardly to gradually open outwardly, a guiding portion 2207 bent inwardly from the end of said contacting portion 2206 and a contacting point 2208 formed at where is bent. A retention portion further is formed on said base portion 2201. According to the preferred embodiment of present invention, said retention portion includes an opening 2210 defined on said base portion and a spring clip 2211 laterally extending from said opening 2210 with regards to said base portion 2201. The structure and function of said spring clip 2211 of said retention portion will be described in more details later.

Figure 6:
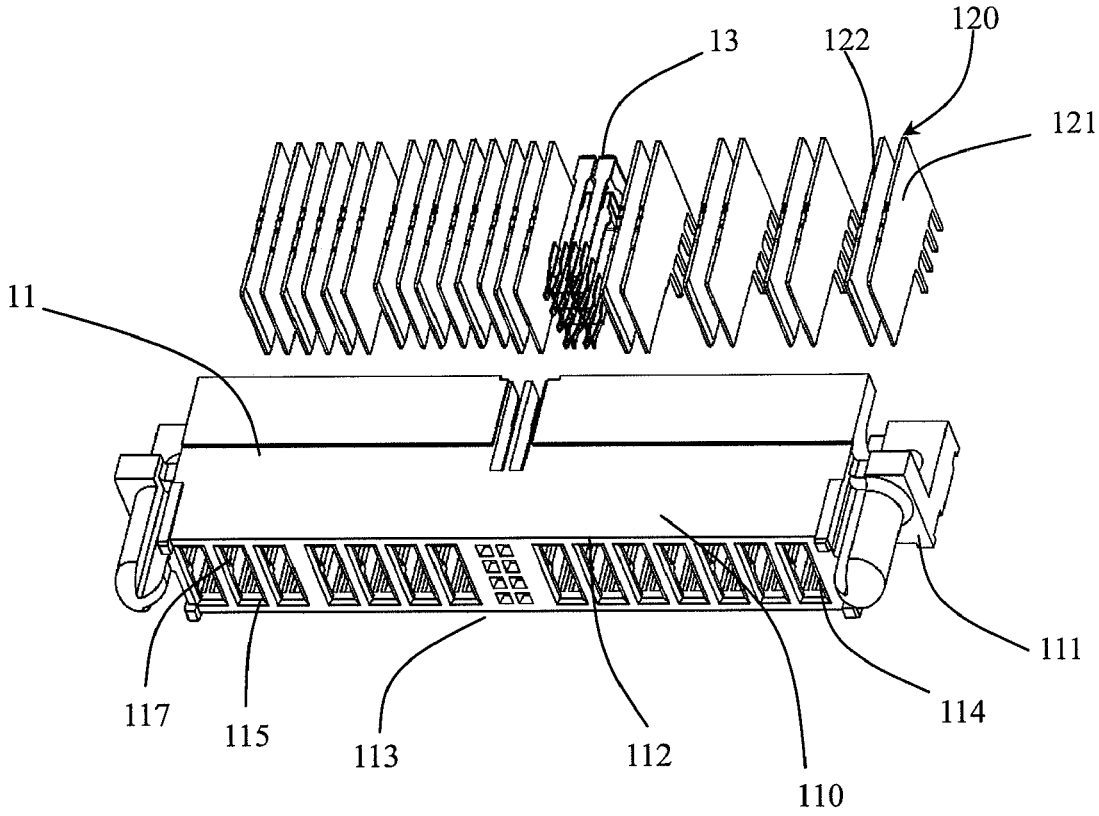
FIG. 6 is an explosively perspective view of a plug connector according to present invention.

Referring to FIG. 6, said plug connector 1 includes an insulating plug housing 11, plug contact pairs 120 assembled in said insulating plug housing 11 and a second signal contact assembly 13. said second signal contact assembly 13 inserted in a plurality of through holes with a matrix array near to the middle of main portion 110 of said insulating plug housing 11 includes a plurality of second signal contacts with a matrix array for signal transmission, wherein the contacting portion of said second signal contact is configured in two-piece of cantilever to receive the first pin signal contact of said receptacle connector 2.

Approximately being an injection molded longitudinally cubic plastic body, said insulating plug housing 11 includes a main portion 110 for receiving said contacts and side portion 111 in both sides of said main portion 110 in a longitudinal direction. Said main portion 110 includes a top wall 112, a bottom wall 113 in parallel relation to said top wall 112, two side walls 114 and a row of plurality of spacer 115 between said top wall 112 and said bottom wall 113. Said spacer 115 extends backwardly from the front of said main portion 110, wherein a contact receiving passage 117 is formed between every two said spacers 115 and has an opening in front of said main portion 110.

Figure 7:
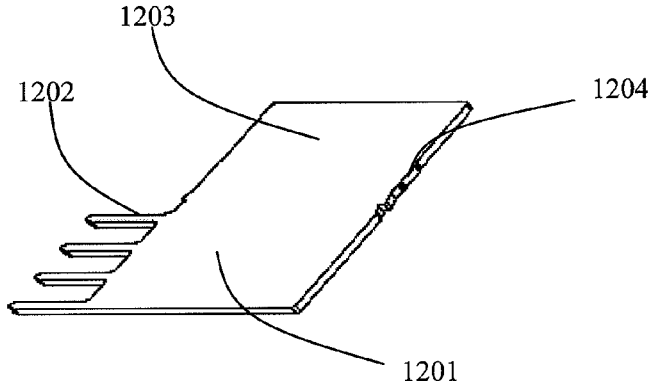
FIG. 7 is a perspective view of a plug contact of the plug connector according to present invention.

Each of said plug contact pairs 120 consists of a pair of independent plug contacts 121, 122. Referring to FIG. 7, each of said plug contacts includes a rectangular planar base portion 1201, a mounting leg 1202 extending downwardly from said base portion 1201, and a contacting portion 1203 extending forwardly from the front of said base portion 2201. A contacting area for mating with said receptacle contact of said receptacle connector 2 is formed on inner side of said contacting portion 1203. According to the preferred embodiment of present invention, each of said plug contacts has four said mounting legs 1202 extending downwardly from the back bottom edge of said base portion 1201 to be welded to the corresponding circuit board by Through-hole Technology. Of course, the number of said mounting leg 1202 may vary to meet the requirements in different designs according to other embodiments of present invention. Moreover, the way to connect said mounting leg with circuit board may also be realized by other common technologies, for example, SMT, or Press-fit Technology. At the top side and bottom side in front of said base portion 1201 a barbed retention portion 1204 is formed respectively. According to the preferred embodiment of present invention, said plug contacts 121, 122 of said plug contact pair 120 are configured parallel, spaced face-to-face with a predetermined distance to form a mating space 1205 (Referring to FIG. 9), and symmetrically mirrored. Said retention portion 1204 on top side edge of said base portion 1201 is near to the middle, said retention portion 1204 on bottom side edge of said base portion 1201 is in front of said mounting leg 1202, a guiding portion 1206 is formed from a chamfer in front of said contacting portion 1203 of said plug contact.

Figure 8:
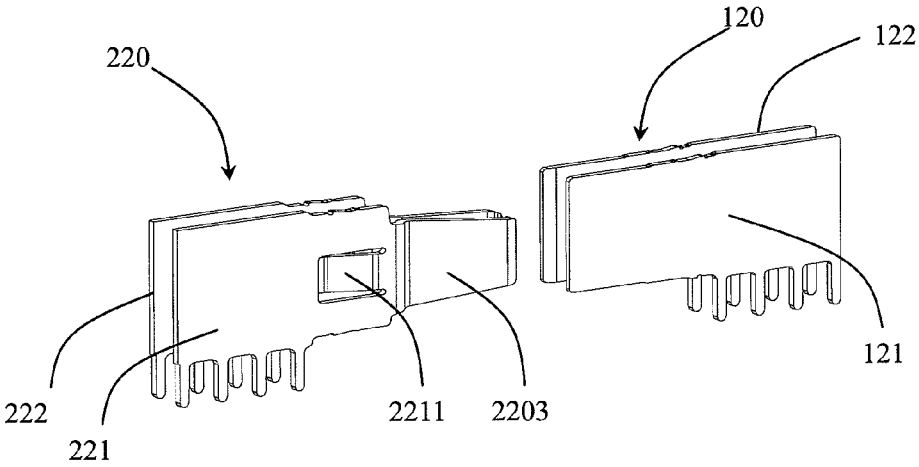
FIG. 8 is a perspective view of an assembly of the receptacle contact of the receptacle connector and the plug contact of the plug connector before mating according to present invention.
Figure 9:
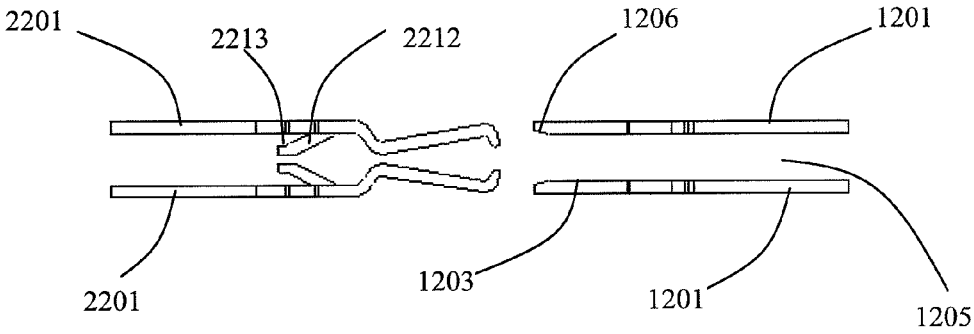
FIG. 9 is a top plan view of FIG. 8.

Referring to FIGS. 8 and 9, said pair of receptacle contacts 221, 222 of said receptacle contact pair 220 is configured in an identical structure and arranged in mirror. A space is formed between the base portion 2202 of said pair of receptacle contacts 221, 222 of said receptacle contact pair, said spring clip 2211 of said receptacle contacts 221, 222 includes an extending portion 2212 obliquely extending in said space with regards to said base portion of the other receptacle contact and a retention end 2213 formed at the end of said extending portion 2212. Said retention end 2213 of said pair of receptacle contacts 221, 222 is spaced with a small gap, which means they are not contacted with each other. Said guiding portion 2207 at the end of said contacting arm 2203 of said receptacle contacts 221, 222 is in accordance with the guiding portion 2206 at the end of said contacting portion 1203 of said plug contacts 121, 122, so as to help insert said receptacle contacts 221, 222 to said mating space 1205 of said plug contacts 121, 122, and the sum of the width of said contacting portion 2203 of said receptacle contacts 221, 222 is slightly more than the width of said mating space of said plug contacts 121, 122.

Figure 10:
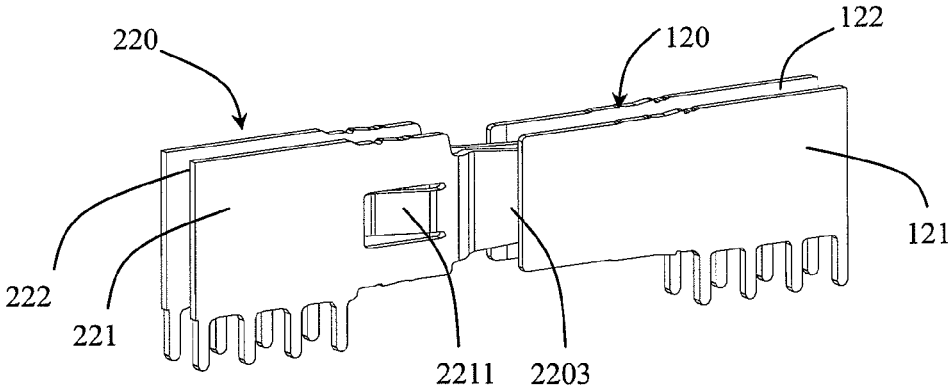
FIG. 10 is a perspective view of an assembly of the receptacle contact of the receptacle connector and the plug contact of the plug connector after mated according to present invention.
Figure 11:
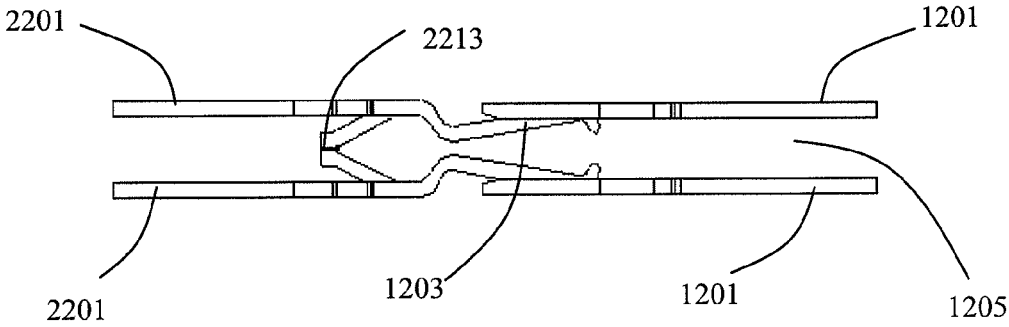
FIG. 11 is a top plan view of FIG. 10.
Figure 12:
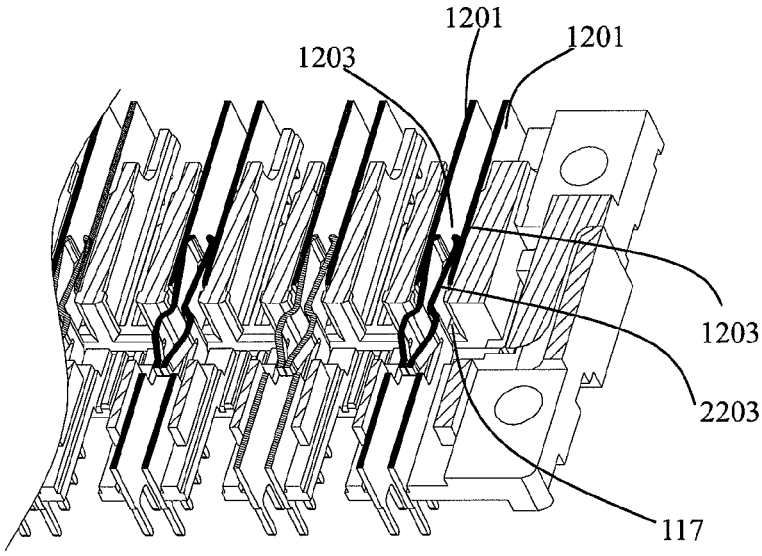
FIG. 12 is a partial cross-sectional view of a power connector assembly taken along the line A-A of FIG. 3.

Referring to FIGS. 10 and 11, after said receptacle contact pair 220 being mated with said plug contact pair 120, said contacting arm 2203 of said receptacle contacts 221, 222 is inserted in said mating space 1205 of said plug contacts 121, 122, which enables said contacting portion 2206 at the front of said contacting arm 2203 of said receptacle contact to be contacted with said contacting portion 1203 of said plug contact. Further referring to FIG. 12, since said main body 1201 and contacting portion 1203 of said plug contacts 121, 122 are tightly attached to side wall of said contact receiving passage 117 and held in said contact receiving passage 117 by said retention portion 1204, said main body 1201 and contacting portion 1203 of said plug contacts 121, 122 will not deform after said receptacle contacts being inserted, whereas the sum of the width of said contacting portion 2203 of said receptacle contacts 221, 222 is slightly more than the that of the mating space 1205 of said plug contacts 121, 122, therefore said contacting arm 2203 of said receptacle contacts 221, 222 will inevitably be bent to each other under the force of said contacting portion 1203 of said plug contacts 121, 122. The deformation of said contacting arm 2203 results in that the retention portion of said receptacle contacts 221, 222 will converge to each other, so as to enable said retention end 2213 of said pair of spring clips 2211 to rest on each other, and to provide an opposite force to said contacting arm 2203 of said receptacle contacts 221, 222, said opposite force will offset the pressing force exerted on said contacting arm 2203 of said receptacle contacts 221, 222 by the contacting portion 1203, to reduce the deformation of the contacting arm 2203 of said receptacle contacts 221, 222.

According to present invention, said receptacle contact of the power connector is configured in two pieces, and the contact retention structure is also configured in two pieces structure. The advantages of two-piece configuration are that the contacts can be manufactured by a continuous injection mould without the problems as occurred when being bent, therefore the quality can be effectively improved, and the cost of manufacturing can be lowered as well. At the same time, it makes the assembly and manufacturing processes easier but ensures the quality, meanwhile the contacts can transmit higher voltage and current under the specification of material conductive characteristics; Furthermore, the advantage of said contact retention structure is that it can prevent the contacts from over deforming under force exerted when the contacts being contacted, so as to ensure the reliability of power transmission.

While the description as set forth is only a preferred embodiment of the present invention, it can also achieved by other various embodiments, for example, according to the preferred embodiment of the present invention, the contact retention structure is defined on said receptacle contact, but in other embodiments, the contact retention structure can also be defined on said plug contact (for instance, between the base portion of said plug contact and side wall of said contact receiving passage). For another example, said contact retention structure is defined on the base portion of the receptacle contact, but in other embodiments, the contact retention structure can also be defined on other portions of the receptacle contact (for instance, at the end of the contacting arm of said receptacle contact in proximity to said base portion). For a further example, said plug connector 1 and said receptacle connector 2 can also be configured in that one of them is assembled on main board or other circuit boards, and the other is connected with a cable, in other words, one of the mounting leg of said receptacle contact could be replaced by a common structure used to connect with a cable. Any equivalent modifications made by a person skilled in the art according to the teaching of the present invention should be construed to be included within the scope or spirit of the appended claims as defined in the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power connector, comprising:

an insulating housing having a plurality of contact receiving passages, a contact pair having a pair of independent conductive contacts received in one of said plurality of contact receiving passages, wherein said independent conductive contact has a base portion, a contacting portion extending from said base portion, and a retention portion extends from at least one of said independent conductive contacts toward another one of said independent conductive contacts, and said retention portion rests on said another one of said independent conductive contacts when said contacting portion deforms under force.

2. The power connector according to claim 1, wherein said pair of independent conductive contacts of said contact pair is spaced and mirrorly secured in the same one of said contact receiving passages.

3. The power connector according to claim 2, wherein each of said conductive contacts has said retention portion extending opposite to said another one of said independent conductive contacts.

4. The power connector according to claim 3, wherein said retention portion of said pair of said independent conductive contacts of each of said contact pair is apart from each other when no force exerted on said contacting portion of said conductive contact.

5. The power connector according to claim 4, wherein said retention portion is disposed on said base portion of said conductive contact, comprising a resilient clip obliquely extending from said base portion to a space formed between said base portion of said pair of independent conductive contacts and a retention end portion defined at the end of said resilient clip.

6. The power connector according to claim 1, wherein said power connector is a receptacle connector, said contact pair is a receptacle contact pair received in said contact receiving passage of said insulating receptacle housing of said receptacle connector.

7. The power connector according to claim 6, wherein said conductive contacts of said receptacle contact pair are receptacle contacts, comprising said base portion and a resilient contacting arm extending from said base portion.

8. The power connector according to claim 1, wherein said power connector is a plug connector, said contact pair is a plug contact pair received in said contact receiving passage of said insulating plug housing of said plug connector.

9. The conductive contact pair according to claim 1, wherein said conductive contact pair is receptacle contact pair to be received in said contact receiving passage of an insulating receptacle housing of a receptacle connector.

10. The conductive contact pair according to claim 9, wherein said conductive contact of said receptacle contact pair is a receptacle contact, having a base portion and a resilient contacting arm extending from said base portion.

11. A power connector assembly, comprising:

a receptacle connector having an insulating receptacle housing and receptacle contact pairs received in contact receiving passages of said insulating receptacle housing, a mating plug connector having an insulating plug housing and plug contact pairs received in contact receiving passages of said insulating plug housing, wherein each of said receptacle contact pairs has a pair of independent receptacle contacts received in a corresponding contact receiving passage of said insulating receptacle housing, each of said receptacle contacts has a retention portion extending opposite to another one of said receptacle contacts, and said retention portion of said pair of receptacle contacts of said receptacle contact pair rests on each other when said receptacle connector is mated with said plug connector.

12. The power connector assembly according to claim 11, wherein said pair of receptacle contacts of said receptacle contact pair is mirrorly received in the same one of said contact receiving passages.

13. The power connector assembly according to claim 12, characterized in that said receptacle contact has a base portion and a resilient contacting arm extending from said base portion, said retention portion being defined on said base portion of said receptacle contact.

14. The power connector assembly according to claim 13, wherein said retention portion has a resilient clip extending to a space formed between said base portion of said pair of independent conductive contacts and a retention end defined at the end of said resilient clip.

15. A conductive contact pair, comprising:

a pair of independent conductive contacts adapted to be received in a contact receiving passage of a power connector, each of said conductive contacts having a base portion and a contacting portion extending from said base portion, wherein at least one of said conductive contacts has a retention portion extending opposite to another one of said conductive contacts; and wherein said retention portion is defined on said base portion and has a resilient clip extending from said base portion, and a retention end is formed at the end of said resilient clip.

16. The conductive contact pair according to claim 15, wherein said pair of independent conductive contacts mirrors each other and a space is formed therebetween.

17. The conductive contact pair according to claim 16, wherein each of said conductive contacts has a retention portion extending opposite to another independent conductive contact.

18. The conductive contact pair according to claim 17, wherein said retention portion of said pair of independent conductive contacts of each of said contact pair is apart from each other when no force exerted on said contacting portion of said conductive contacts.

19. The conductive contact pair according to claim 15, wherein said conductive contact pair is plug contact pair to be received in contact receiving passage of an insulating plug housing of a plug connector.

* * * * *